United States Patent [19]

Welch

[11] 4,311,018

[45] Jan. 19, 1982

[54] CRYOGENIC PUMP

[75] Inventor: Kimo M. Welch, Mountain View, Calif.

[73] Assignee: Varian Associates, Inc., Palo Alto, Calif.

[21] Appl. No.: 189,524

[22] Filed: Sep. 22, 1980

Related U.S. Application Data

[63] Continuation of Ser. No. 104,214, Dec. 17, 1979, abandoned.

[51] Int. Cl.[3] ..... F25D 5/00

[52] U.S. Cl. ..... 62/55.5; 55/269; 62/268; 417/901

[58] Field of Search ..... 62/55.5, 100, 268; 55/269; 417/901

[56] References Cited

U.S. PATENT DOCUMENTS

| | | | |
|---|---|---|---|
| 3,081,068 | 3/1963 | Milleron | 62/55.5 |
| 3,122,896 | 3/1964 | Hickey | 62/55.5 |
| 3,137,551 | 6/1964 | Mark | 62/55.5 |
| 3,423,947 | 1/1969 | Moriya | 62/55.5 |
| 3,512,369 | 5/1970 | Houyvet et al. | 62/55.5 |
| 4,150,549 | 4/1979 | Longsworth . | |

OTHER PUBLICATIONS

R/D Research Development, Technical Publishing Company, Oct. 1977, p. 93.

Air Products Laboratory Cryogenic Systems, Air Products and Chemicals, Inc., 1978.

Air Products Data Sheet HV-200-3/79, Air Products and Chemicals Inc., 1979.

*Primary Examiner*—Ronald C. Capossela

*Attorney, Agent, or Firm*—Stanley Z. Cole; Leon F. Herbert

[57] ABSTRACT

A cryogenic apparatus comprises refrigeration means utilizing a two-stage expansion of compressed helium gas that circulates in a closed loop, whereby a first pumping stage can be maintained at a temperature in the range from 50° K. to 80° K. and a second pumping stage can be maintained at a colder temperature in the range from 10° K. to 20° K. The first pumping stage comprises an array of louvers of chevron configuration. These louvers enclose the second pumping stage, and serve as baffles to shield the pumping surfaces of the second stage from thermal radiation that would reduce the usable refrigeration capacity of the second stage for removing gases from a chamber to be evacuated. The chevroned baffles also protect a cryosorbent coating on the interior surfaces of the second stage from becoming iced or plugged by gas species that cryocondense at the higher temperature of the first stage. The assembly comprising the first-stage array of chevroned baffles surrounding the second-stage pumping surfaces may be disposed directly in the chamber to be evacuated, or may be mounted in a housing structure coupled to the chamber. The housing structure preferably has a radially bulging cylindrical configuration that permits substantially unimpeded conductance of gases from the chamber to the first-stage chevroned baffles.

21 Claims, 3 Drawing Figures

CRYOGENIC PUMP

This is a continuation of application Ser. No. 104,214 filed Dec. 17, 1979, now abandoned.

BACKGROUND OF THE INVENTION

A surface that is maintained at a temperature colder than its environment removes (i.e., "pumps") gases from the environment by the physical processes of condensation and/or adsorption. This pumping on a cold (i.e., "cryogenic") surface is termed "cryopumping" from the Greek word "kryos" meaning "cold". The process of condensation on a cryogenic surface is termed "cryocondensation", and the process of adsorption on a cold surface is termed "cryosorption".

The present invention pertains to a closed-cycle, two-stage cryogenic pumping apparatus. In operation, the first pumping stage is typically maintained at a cold temperature in the range, e.g., from 50° K. to 80° K., and the second pumping stage is maintained at a colder temperature in the range, e.g., from 10° K. to 20° K. The first pumping stage is generally configured to provide gas conductance passages whereby gas species that impinge upon but are not cryopumped at the first stage can pass through the first stage to the colder second stage. Thus, gases such as water vapor and carbon dioxide, whose heats of condensation, heats of solidification and specific heats are such that their cryocondensation can occur at the higher first-stage temperature, are pumped at the first stage; and gases that require a lower temperature for cryocondensation or cryosorption (e.g., helium, hydrogen and neon) are pumped at the second stage.

It is a primary function of the first pumping stage to remove substantially all the gases that can be cryopumped at the first-stage operating temperature, so as to prevent such gases from loading the surfaces of the colder second pumping stage. In this way, the capacity of the second stage for cryopumping the remaining gases can be maximized. Another function of the first stage is to shield the colder second stage from thermal radiation that would reduce the usable refrigeration capacity of the second-stage surfaces for pumping gases.

In a two-stage cryogenic pumping system, the second pumping stage is often configured as a structure having a smooth exterior surface and an interior surface that is coated with a cryosorbent material such as activated charcoal or an artificial zeolite. With such a second-stage structure, gases such as helium, hydrogen and neon that do not readily cryocondense on the relatively smooth exterior surface can be cryosorbed in the interstices of the coating material on the interior surface.

A detailed overview of cryogenic pumping is provided in an article entitled "Helium Cryopumping" by Kimo M. Welch and Chris Flegal, which was published in *Industrial Research/Development,* March 1978, pages 83–88. The illustration appearing on page 83 of that article shows a typical prior art cryogenic pump configuration. In that typical configuration, the first pumping stage comprised a cup-like structure having solid side and bottom walls, with a panel of chevroned baffles forming a planar cover at the upper end; and the second pumping stage was enclosed within the first pumping stage and had the form of an inverted cylindrical cup with an open bottom end.

A problem associated with cryogenic pumps of the prior art was their low pumping speed. Whatever configuration such prior art pumps may have had for the first-stage pumping structure gas transmission to the second stage was generally possible only through a very limited surface area on the first-stage structure. For the typical prior art configuration illustrated in the above-cited "Helium Cryopumping" article, for example, the panel of chevroned baffles of the first-stage pumping structure permitted gas transmission to the second stage only in two dimensions through the plane at the top of the cup-like first-stage structure. Furthermore, with that typical prior art configuration, gas species passing through the first-stage baffles could reach the interior surfaces of the second-stage pumping structure only via a tortuous path downward through the annular region between opposing surfaces of the two pumping stages and thence into the interior of the second-stage structure.

SUMMARY OF THE INVENTION

In a cryogenic pumping apparatus, (a) in which two pumping stages at different temperatures are provided by the expansion in successive stages of a compressed refrigerating gas circulating in a closed loop, and (b) in which the first pumping stage comprises an array of louvered surfaces to shield the colder second pumping stage from radiation that would otherwise reduce the effective refrigeration capacity of the second stage for pumping gases, it is an object of this invention to provide a configuration for the array of first-stage pumping surfaces that minimizes impedance in the flow to the second stage of those gases that do not cryocondense at the higher temperature of the first stage.

It is a concomitant object of this invention to provide a configuration for the array of first-stage pumping surfaces that prevents pumping at the second stage of those gases that cryocondense at the higher temperature of the first stage.

It is also an object of this invention to provide a second-stage pumping structure having an exterior surface for cryocondensation, and a coated interior surface for cryosorption of gases such as helium, hydrogen and neon that do not cryocondense at the temperature of the second stage, where the area of the second-stage cryosorptive coated surface is maximized without adversely affecting gas conductance to the interior of the second-stage pumping structure.

It is a further object of this invention to accomplish the foregoing objects with a cryogenic pumping apparatus having a relatively compact overall configuration.

In order to achieve the foregoing objects, a cryogenic pumping apparatus according to the present invention comprises refrigeration means utilizing a two-stage expansion of compressed helium gas circulating in a closed loop, whereby a first pumping stage can be maintained at a temperature in the 50° K. to 80° K. range and a second pumping stage can be maintained at a colder temperature in the 10° K. to 20° K. range. The first pumping stage comprises an array of chevroned baffles disposed in a generally conical arrangement surrounding the second pumping stage, whereby the second stage is shielded from ambient radiation. A cryosorbent material is coated on interior surfaces of the second-stage structure for pumping by cryosorption of gas species that do not cryocondense at the first-stage temperature or even at the colder temperature of the second-stage structure. The array of chevroned baffles of the surrounding first stage protects the cryosorbent coating material on the second stage from icing or plugging by gas species that solidify by cryocondensation at the first stage. The chevroned baffles of the first stage are arrayed to permit substantially uniform gas transmission to the second-stage structure through the spaces between adjacent baffles; yet the baffles are spaced closely enough together to preclude line-of-sight transmission of radiation into the interior of the first-stage structure.

In a particular embodiment of this invention, the assembly comprising the first-stage array of chevroned baffles surrounding the second-stage pumping structure is disposed in a housing structure that can be coupled in vacuum-tight communication to the chamber to be evacuated. The configuration of the housing structure is such as to maximize the conductance of gases to the vicinity of the array of chevroned baffles for cryocondensation thereon or for transmission therethrough to the second pumping stage. In the preferred embodiment, the housing structure has a generally cylindrical configuration with a radial bulge being provided in the vicinity of the enclosed array of chevroned baffles so as to prevent constriction of gas flow between the interior wall of the housing structure and the array of chevroned baffles.

In an alternative embodiment of this invention, the assembly comprising the first-stage array of chevroned baffles surrounding the second-stage pumping structure is disposed directly and uncovered in the chamber to be evacuated. In this way, totally unobstructed conductance of gases from the chamber to the array of first-stage pumping surfaces can be provided.

A feature of a cryogenic pumping apparatus according to the present invention is that the surface area of the cryosorbent coating on the interior of the second-stage pumping structure is as large as practicable. In the preferred embodiment, the second-stage pumping structure comprises a hollow cyclindrical inner member surrounded by a coaxially disposed hollow frustroconical outer member. The narrower end of the frustroconical outer member and one end of the cylindrical inner member are attached to a common end-plate so as to form an integral second-stage structure. The wider end of the frustoconical member and the other end of the cylindrical member are open and are generally co-planar with each other. The exterior surface of the frustroconical member and the exterior surface of the end-plate to which it is attached are uncoated metallic surfaces upon which cryocondensation can occur. The interior surfaces of the frustroconical member and of the end-plate, as well as both the interior and exterior surfaces of the cylindrical member, are coated with a cryosorbent material such as activated charcoal or an artificial zeolite. The presence of the cryosorbent-coated cylindrical member in the interior of the second-stage pumping structure effectively increases the surface area available for crysorption of helium, hydrogen and neon by a factor of about 3, thereby providing a threefold increase in the pumping capacity of the second-stage structure for these gases.

DESCRIPTION OF THE PREFERRED EMBODIMENT

Figures 1, 2, 3:
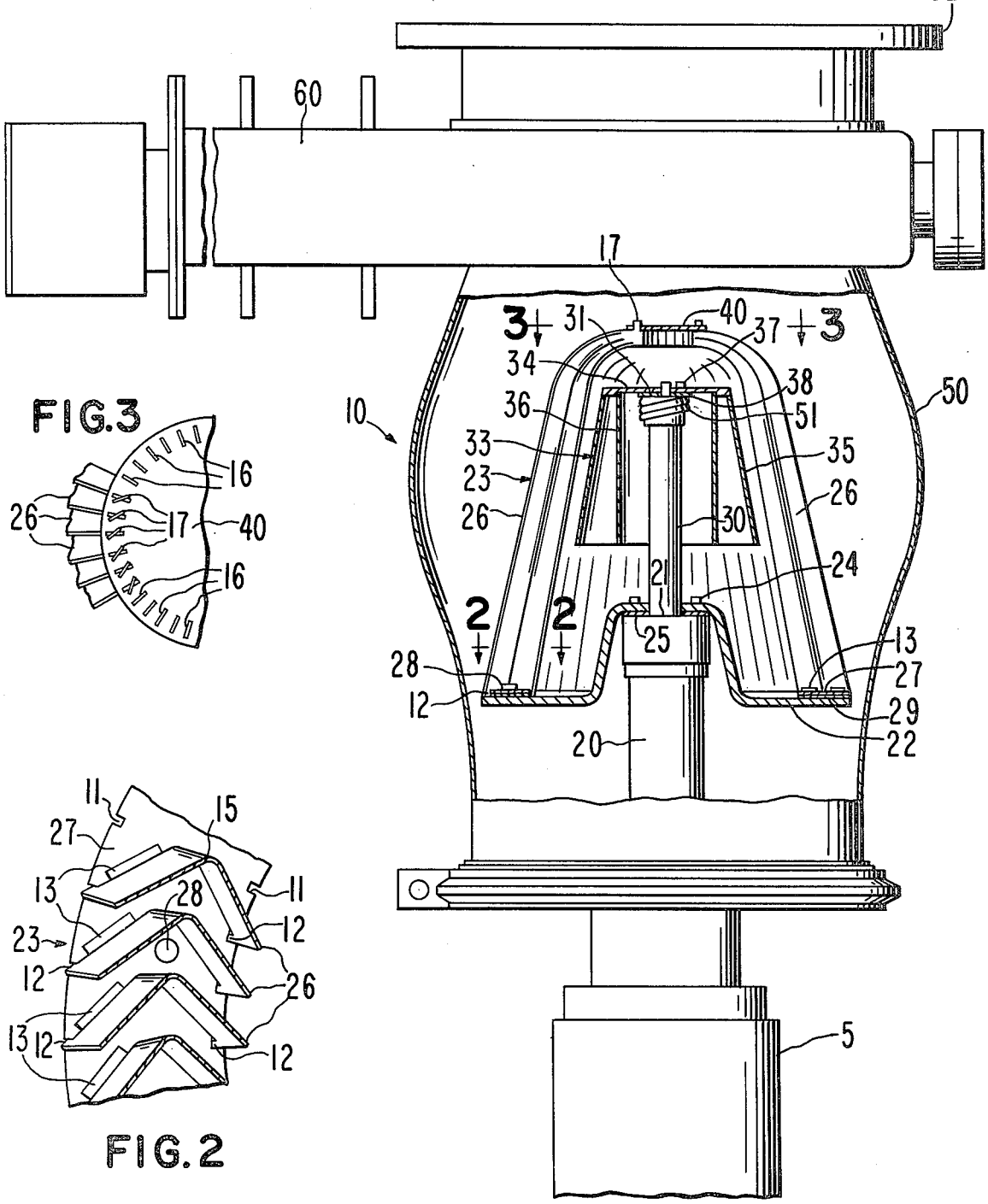
FIG. 1 is a cross-sectional view, partly schematic, of a two-stage cryogenic pumping apparatus according to the present invention.
FIG. 2 is a fragmentary view taken along line 2—2 of FIG. 1 to show how the bottom ends of the chevroned baffles of the first pumping stage are mounted on their support structure.
FIG. 3 is a fragmentary view taken along line 3—3 of FIG. 1 to show how the top ends of the chevroned baffles of the first pumping stage are affixed to their retaining structure.

A cross-sectional view, partly schematic, of a two-stage cryogenic pumping apparatus 10 according to the present invention is shown in FIG. 1. The pumping apparatus 10 operates in combination with a closed-loop refrigeration system in which compressed helium gas is allowed to expand in two successive stages. According to the usual arrangement, a two-stage expander 15 forms an integral part of the pumping apparatus 10, while a compresser unit in which the helium is compressed is located remote from the pumping apparatus 10. However, the compressor unit could be integral with the expander 15 as in, e.g., the Type K-20 cryogenerator system of N. V. Philips Gloeilampenfabrieken.

As shown in FIG. 1, the two-stage expander 15 is an elongate structure such as the Model CSW-202 Displex closed-cycle refrigeration system marketed by Air Products and Chemicals, Inc. of Allentown, Pennsylvania. In the usual arrangement, the expander 15 is coupled to a remotely located compressor by piping or flexible metal hose according to techniques well-known to those skilled in the cryogenic pumping art. For a technical description of the refrigeration principle used in the preferred embodiment of this invention, see W. E. Gifford, "The Gifford-McMahon Cycle", *Advances in Cryogenic Engineering,* 11 (Plenum Press, 1966), especially pp. 152 et seq., which discusses a modified Solvay thermodynamic cycle.

The first-stage expansion of helium gas occurs in an expansion chamber 20 of the expander 5, and thereby causes the distal end wall 21 of the chamber 20 to assume a desired first-stage cryogenic temperature. Typically, this first-stage temperature is selected to be in the 50° K. to 80° K. range. The second-stage expansion of the helium gas occurs in an expansion chamber 30, and thereby causes the distal end wall 31 of the chamber 30 to assume a desired colder second-stage cryogenic temperature. Typically, the second-stage temperature is chosen to be in the 10° K. to 20° K. range. The temperatures attainable at the first and second refrigeration stages are determined by the parameters of the refrigeration system.

As shown in FIG. 1, the expansion chambers 20 and 30 are of generally cylindrical configuration, and are disposed adjacent one another along a common axis, i.e., they are co-axial with a longitudinal axis. The expansion chamber 20 has a broader diameter than the adjacent expansion chamber 30, and thus the exterior surface of the end wall 21 of the expansion chamber 20 provides an annular shelf surrounding the junction of the two expansion chambers. An aluminum support structure 22 is affixed by bolts 24 to this annular shelf on the end wall 21, and an array 23 of first-stage cryopumping surfaces is mounted on the support structure 22. Intimate thermal contact between the support structure 22 and the end wall 21 is provided by a layer of indium foil 25 compressed therebetween. Plastic deformation of the indium foil occurs when the bolts 24 are tightened, thereby causing indium to flow so as to fill whatever crevices or cavities might exist between the support structure 22 and the end wall 21. Alternatively, the support structure 22 could be secured to the end wall 21 by brazing.

The support structure 22 is configured to skirt a portion of the expansion chamber 20 in the axial dimension, so that the perimeter of the support structure 22 is not co-planar with the end wall 21. The cryopumping surfaces of the array 23 are mounted adjacent the perimeter of the support structure 22, and thus have a longer longitudinal extension projected along the axis of the expansion chambers 20 and 30 than would be possible if the support structure 22 were to extend laterally in the same plane as the end wall 21.

The array 23 comprises a plurality of elongated baffles 26 made of copper or other material of high thermal conductivity. Each of the baffles 26 is made from a strip of material that is folded along a longitudinal crease 15 into the configuration of an angle iron having a lateral cross section shaped like a chevron. Alternatively, such a chevroned baffle could be fabricated from separate strips of material meeting at a junction line that corresponds to the crease 15 so as to provide a structure having the configuration of an angle iron. The lateral extension of the arms of the cross-sectional chevron varies uniformly from a maximum at one end of the crease or junction line 15 to a minimum at the other end.

The bottom ends of the baffles 26 (i.e., where the chevroned cross-sections of the baffles 26 have their greatest lateral extension) are mounted around the perimeter of a planar mounting member 27, which is preferably made of copper, so that the crease or junction line 15 of any one baffle is skirted by the arms of an adjacent baffle. In this way, each chevroned baffle is nested within yet separated from an adjacent baffle. The bottom end of each baffle 26 in contact with the surface of the mounting member 27 is angled so that the crease or junction line 15 leans inwardly toward the axis of the expansion chambers 20 and 30. Furthermore, each of the baffles 26 is arcuately bent inward at its narrow upper end toward the axis of the expansion chambers 20 and 30 for attachment to a retaining member 40.

In the preferred embodiment, the mounting member 27 is a planar ring and the retaining member 40 is a disc. Thus, the baffles 26 are preferably arranged so that their creases or junction lines 15 lie in a circle on the mounting ring 27. The resulting three-dimensional array 23 of first-stage pumping surfaces is therefore of generally conical configuration enclosing a volume within which a second-stage pumping structure 33 can be mounted on the end wall 31 of the expansion chamber 30.

It is advantageous for the chevroned baffles 26 to be blackened so as to intercept all thermal radiation from external sources and to prevent reflection of thermal radiation through the baffles 26 to the second-stage structure 33. Blackening of the baffles 26 can be accomplished chemically, as by oxidation, or by use of a light-absorbent paint.

According to the mounting technique shown in FIG. 2, the mounting ring 27 is provided with slots 11, preferably uniformly spaced, along its inner and outer perimeters. Mating tabs 12 projecting from the bottom ends of the baffles 26 adjacent their longitudinal edges are inserted into the slots 11 to hold the baffles 26 in place on the ring 27. Flat tabs 13, which extend from the bottom edges of the baffles 26 and are folded to lie in the plane of the ring 27, are brazed or soldered to the ring 27. The individual chevron-shaped baffles 26 are spaced apart from each other, preferably evenly spaced about ring 27 to provide multiple substantially equal conductance gas flow paths, in close enough proximity to each other to preclude line-of-sight passage of thermal radiation or gas between adjacent baffles to the interior of the array 23. The mounting ring 27 is affixed to the perimeter of the support structure 22 by bolts 28. Intimate thermal contact between the support structure 22 and the ring 27 is provided by a layer of indium foil 29 compressed therebetween. In a particular embodiment, for a bolt-circle of 6.4-inch diameter on the mounting ring 27, twenty equally spaced bolts 28 are used to affix the ring 27 to the support structure 22, and forty chevroned baffles are brazed onto the ring 27.

The top end of each of the baffles 26 of the array 23 is attached to the circular retaining disc 40, which is preferably made of copper, and which serves to maintain uniform spacing between the baffles 26 while holding them rigidly in the generally conical configuration. As shown in FIG. 3, the disc 40 is provided with uniformly spaced slots 16 near its perimeter. Each slot 16 receives a mating tab 17 projecting from the top edge of a baffle 26. The tabs 17, after being inserted into the slots 16, are twisted so as to be held securely by the disc 40, and are thereafter brazed or soldered to the disc 40.

The first-stage array 23 of chevroned baffles 26, together with the bottom support structure 22 and the top retaining disc 40, surround the second-stage pumping structure 33 mounted on the end wall 31 of the expansion chamber 30. The second-stage pumping structure 33 is configured to present as large a surface area as practicable to gas species entering the interior of the first-stage array 23 through the spaces between adjacent chevroned baffles 26. For this reason, the configuration of the exterior surface of the second-stage pumping structure 33 conforms generally to the silhouette of the array 23 of the chevroned baffles of the surrounding first-stage pumping structure. Thus, where the first-stage array 23 has a generally conical configuration as in the preferred embodiment, a frustroconical configuration is chosen for the exterior of the second-stage structure 33 in order to conform generally to the silhouette of the first-stage array 23.

The second-stage pumping structure 33 comprises a plate 34 affixed to and extending beyond the perimeter of the end wall 31 of the expansion chamber 30, a hollow frustoconical member 35 affixed to the plate 34 so as to skirt a portion of the expansion chamber 30, and a hollow cylindrical member 36 affixed to the plate 34 so as to skirt the expansion chamber 30 within the interior of the frustoconical member 35. Preferably, the cylindrical member 36 and the surrounding frustoconical member 35 are coaxially disposed with respect to each other. The plate 34, the frustoconical member 35, and the cylindrical member 36 are all preferably of copper, and are assembled by brazing or soldering to form a unitary structure. The plate 34 is affixed to the end wall 31 of the expansion chamber 30 by bolts 37. Intimate thermal contact between the plate 34 and the end wall 31 is provided by a layer of indium foil 38 compressed therebetween.

The exterior surface of the frustoconical member 35 and the exterior surface of the plate 34 are preferably highly reflective, as by being nickel plated, to prevent absorption of thermal radiation. The inner surfaces of the second-stage pumping structure 33 (i.e., the interior surface of the plate 34, the interior surface of the frustoconical member 35, and both the inner and outer walls of the cylindrical member 36) are preferably coated with a cryosorbent material such as activated charcoal or an artifical zeolite. The effective surface area of activated charcoal is on the order of hundreds of square meters per gram, so that a coating of activated charcoal greatly increases the cryosorption capability of the second-stage pumping structure. The additional cryosorbent surface area provided by the cylindrical member 36 in the interior of the second-stage pumping structure 33 provides greater storage capacity for helium, hydrogen and neon than would be possible if only the interior surface of the frustoconical member 35 were available for coating with cryosorbent material. Experiments indicate that the increase in storage capacity for these gases provided by the cryosorbent-coated cylindrical member 36 is from 300% to 600%.

As shown in FIG. 1, a capillary tube 51 filled with hydrogen gas extends from a position in intimate thermal contact with the distal end of the second-stage expansion chamber 30 to a hydrogen vapor pressure gauge (not shown) located remote from the expansion chamber 30. At operating temperatures of the second-stage pumping structure 33, the vapor pressure of hydrogen gas varies monotonically and predictably with temperature. Thus, measurement of the hydrogen pressure in the capillary tube 51 provides a direct indication of the temperature at the distal end of the expansion chamber 30, and therefore of the temperature of the second-stage pumping structure 33 in intimate thermal contact therewith.

In applications where unimpeded conductance of gas to the first-stage pumping surfaces is especially important, the assembly comprising the array 23 of chevroned baffles surrounding the second-stage pumping structure 33 can be mounted directly in the chamber to be evacuated. In many applications, however, it is desirable for a cryopump to communicate with the interior of the chamber to be evacuated through a port in the chamber wall. In an application of this latter kind, the assembly comprising the first-stage array 23 of chevroned baffles surrounding the second-stage pumping structure 33 can be mounted within a gas-tight housing structure 50 that is attachable by means of a flange 52 to a mating flange defining the port through which the chamber is to be evacuated. A number of vacuum-tight flange arrangements are known to those skilled in the cryogenic pumping art. (See, e.g., U.S. Pat. No. 3,208,758, assigned to Varian Associates, Inc.)

In particular applications, it might be desirable to interpose a vacuum valve 60 between the chamber to be evacuated and the pumping apparatus 10 described herein. For such applications, the vacuum valve 60 could advantageously be an integral part of the pumping apparatus 10 as shown in FIG. 1. With such an integral arrangement, the necessity for flanges between the pumping apparatus and the vacuum valve is obviated.

In order to provide maximum unobstructed gas transmission from the chamber being evacuated to the array 23 of first-stage pumping surfaces, the housing structure 50 is configured so as to preclude constriction of the gas flow passageway between the inner wall of the housing structure 50 and the first-stage array 23. Thus, the wall of the housing structure 50 may be bulged radially outward from true cylindrical configuration in the vicinity of the first-stage array 23. A gap is provided between the support structure 22 and the inner wall of the housing structure 50 through which ices and other debris can fall so as to avoid forming a solid "bridge" that might serve as a thermal short between the housing structure 50 and the first-stage pumping surfaces.

This invention has been described above in terms of a preferred embodiment. The three-dimensional arrangement of louvered pumping surfaces of the first-stage structure described above provides maximum gas transmission to the second-stage structure through the solid angle defined by the first-stage structure positioned around the second-stage structure, and at the same time minimizes the transmission of thermal radiation to the second-stage structure. It should be recognized that, in light of the foregoing disclosure, other first-stage structural configurations could be devised to provide such optimum three-dimensional gas conductance while preventing line-of-sight radiation transmission to the second stage. Such configurations would be fully within the scope of the present invention. Thus, the foregoing description is to be construed as illustrative rather than limiting, and the invention is defined in terms of the following claims.

What is claimed is:

1. A cryogenic pumping apparatus comprising:

a first-stage expansion chamber to accommodate expansion of a refrigerant gas whereby a portion of said first-stage expansion chamber can be maintained at a first temperature;

a second-stage expansion chamber to accommodate a further expansion of said refrigerant gas whereby a portion of said second-stage expansion chamber can be maintained at a second temperature, said second temperature being lower than said first temperature;

a first-stage pumping structure in intimate thermal contact with said first-stage expansion chamber;

a second-stage pumping structure in intimate thermal contact with said second-stage expansion chamber;

said first-stage pumping structure comprising an array of baffles, the baffles of said array being spaced apart from each other and arranged to form a wall around said second-stage pumping structure, said wall preventing line-of-sight transmission of radiation to said second-stage pumping structure, gas conductance to said second-stage pumping structure being permitted uniformly through said wall via spaces between adjacent baffles of said array.

2. The apparatus of claim 1 wherein each of said baffles has a cross-sectional configuration resembling a chevron, and wherein said baffles are arranged with respect to each other so that a cross section through adjacent baffles resembles nested chevrons.

3. The apparatus of claim 1 wherein said baffles are arranged to form a generally conical structure around said second-stage pumping structure.

4. The apparatus of claim 1 wherein said second-stage pumping structure has a reflective exterior surface and a cryosorbent-coated interior surface.

5. The apparatus of claim 1 wherein said second-stage pumping structure is configured to conform generally to the silhouette of said first-stage pumping structure.

6. The apparatus of claim 5 wherein said array of baffles forms a generally conical structure surrounding said second-stage pumping structure, and wherein said second-stage pumping structure is of frustoconical configuration.

7. The apparatus of claim 6 wherein said second-stage pumping structure comprises a hollow frustoconical outer member surrounding a coaxially disposed hollow cylindrical inner member.

8. The apparatus of claim 7 wherein the inner surface of said hollow frustoconical member and the outer and inner surfaces of said hollow cylindrical member are coated with a cryosorbent material.

9. The apparatus of claim 8 wherein said cryosorbent material is charcoal.

10. The apparatus of claim 8 wherein said crysorbent material is an artifical zeolite.

11. The apparatus of claim 1 wherein said first-stage pumping structure said second-stage pumping structure are enclosed within a housing structure that can be coupled to a chamber to be evacuated.

12. The apparatus of claim 11 wherein said housing structure is of generally cylindrical configuration with an axial bulge in the vicinity of said first-stage pumping structure.

13. The apparatus of claim 1 wherein said baffles are blackened.

14. A cryogenic pumping apparatus comprising:

a first-stage expansion chamber is accommodate expansion of a refrigerant gas whereby a portion of said first-stage expansion chamber can be maintained at a first temperature;

a second-stage expansion chamber to accommodate a further expansion of said refrigerant gas whereby a portion of said second-stage expansion chamber can be maintained at a second temperature, said second temperature being lower than said first temperature;

a first-stage pumping structure in intimate thermal contact with said first-stage expansion chamber;

a second-stage pumping structure in initimate thermal contact with said second-stage expansion chamber;

said first-stage pumping structure comprising an array of baffles, the baffles of said array being spaced apart from each other and arranged to form a wall around said second-stage pumping structure, said wall preventing line-of-sight transmission of radiation to said second-stage pumping structure, the baffles of said array being arranged so that a multiplicity of substantially evenly distributed gas flow paths having substantially equal flow conductance are provided through the array to the second-stage structure.

15. A cryogenic pumping apparatus comprising:

a first-stage expansion chamber to accommodate expansion of a refrigerant gas whereby a portion of said first-stage expansion chamber can be maintained at a first temperature;

a second-stage expansion chamber to accommodate a further expansion of said refrigerant gas whereby a portion of said second-stage expansion chamber can be maintained at a second temperature, said second temperature being lower than said first temperature;

a first-stage pumping structure in intimate thermal contact with said first-stage expansion chamber;

a second-stage pumping structure in intimate thermal contact with said second-stage expansion chamber;

said first-stage and second-stage expansion chambers being co-axial with a longitudinal axis, the first and second stage pumping structures being co-axial with the longitudinal axis, the second-stage chamber and structure being closer to the axis than the first-stage chamber and structure;

said first-stage pumping structure comprising an array of balles, the baffles of said array being spaced apart from each other and arranged to form a wall around said second-stage pumping structure, said wall preventing line-of-sight transmission of radiation to said-second stage pumping structure, the baffles of said array being arranged so that a multiplicity of gas flow paths having radial and longitudinal components relative to the axis are provided through the array to the second structure.

16. The apparatus of claim 15 wherein the baffles of the array are arranged so that a multiplicity of substantially evenly distributed gas flow paths are provided through the array to the second-stage structure.

17. The apparatus of claim 15 wherein the baffles of the array are arranged so that a multiplicity of substantially evenly distributed gas flow paths having substantially equal flow conductance are provided through the array to the second stage structure.

18. A cryogenic pumping apparatus comprising:

a first-stage expansion chamber to accommodate expansion of a refrigerant gas whereby a portion of said first-stage expansion chamber can be maintained at a first temperature;

a second-stage expansion chamber to accommodate a further expansion of said refrigerant gas whereby a portion of said second-stage expansion chamber can be maintained at a second temperature, said second temperature being lower than said first temperature;

a first-stage pumping structure in intimate thermal contact with said first-stage expansion chamber;

a second-stage pumping structure in intimate thermal contact with said second-stage expansion chamber;

said first-stage pumping structure comprising an array of baffles, the baffles of said array being spaced apart from each other and arranged to form a wall around said second-stage pumping structure, said wall preventing line-of-sight transmission of radiation to said second-stage pumping structure, the baffles of said array being arranged so that a multiplicity of substantially evenly distributed gas flow paths are provided through the array to the second stage structure.

19. In a cryogenic pumping apparatus having a first-stage expansion chamber to accommodate expansion of a refrigerant gas whereby a portion of said first-stage expansion chamber can be maintained at a first temperature; a second-stage expansion chamber to accommodate a further expansion of said refrigerant gas whereby a portion of said second-stage expansion chamber can be maintained at a second temperature, said second temperature being lower than said first temperature; a second-stage pumping structure in intimate thermal contact with said second-stage expansion chamber;

a first-stage pumping structure adapted to be mounted in intimate thermal contact with said first-stage expansion chamber comprising: an array of baffles, the baffles of said array being spaced apart from each other and arranged so they are adapted to form a wall around said second-stage pumping structure, said wall being adapted to prevent line-of-sight transmission of radiation to said second-stage pumping structure, the baffles of the array adapted to provide uniform gas conductance from the first chamber to the second-stage through said wall via spaces between adjacent baffles of the wall.

20. The apparatus of claim 19 wherein the baffles of the array are arranged so that a multiplicity of substantially evenly distributed gas flow paths having substantially equal flow conductance are adapted to be provided through the array to the second stage structure.

21. The apparatus of claim 19 wherein the baffles of the array are arranged so that a multiplicity of substantially evenly distributed gas flow paths are adapted to be provided through the array to the second stage structure.

* * * * *